US005752222A

United States Patent [19]

Nishiguchi et al.

[11] Patent Number: 5,752,222

[45] Date of Patent: May 12, 1998

[54] SPEECH DECODING METHOD AND APPARATUS

[75] Inventors: Masayuki Nishiguchi, Kanagawa; Kazuyuki Iijima, Saitama; Jun Matsumoto; Shiro Omori, both of Kanagawa, all of Japan

[73] Assignee: Sony Corporation, Tokyo, Japan

[21] Appl. No.: 736,342

[22] Filed: Oct. 23, 1996

[51] Int. Cl.[6] ..... G10L 3/02; G10L 9/00

[52] U.S. Cl. ..... 704/201; 704/223

[58] Field of Search ..... 704/201, 208, 704/214, 219, 220, 225, 222, 223

[56] References Cited

U.S. PATENT DOCUMENTS

| | | | |
|---|---|---|---|
| 5,307,441 | 4/1994 | Tseng | 704/222 |
| 5,339,384 | 8/1994 | Chen | 704/211 |
| 5,574,825 | 11/1996 | Chen et al. | 704/228 |
| 5,651,091 | 7/1997 | Chen | 704/223 |
| 5,664,055 | 9/1997 | Kroon | 704/223 |

OTHER PUBLICATIONS

Yang, Gao et al., "a robust and fast DP–CELP(Double–Pulse CELP) Vocoder at the Bit Rate of 4 kb/s" Speech, Image Processing, and Neural Networks 1994 Int'l Symposium,pp. 563–566.

Yang, Haiyun et al., "a 5.4 kbps Speech Coder Based on Multi–Band Excitation and linear Predictive Coding" TENCON '94, pp. 417–421.

Ramamoorthy, V. et al., "enhancement of ADPCM Speech Coding with Backward–Adaptive Algorithms for Postfiltering and Noise Feedback" IEEE Journal on Selected Areas in Communications, 1988, pp. 364–382.

*Primary Examiner*—David R. Hudspeth
*Assistant Examiner*—Patrick N. Edouard
*Attorney, Agent, or Firm*—Jay H. Maioli

[57] ABSTRACT

A speech decoding method and apparatus for decoding encoded speech signals and subsequently post-filtering the decoded signals, wherein the filter coefficient of a spectral shaping filter in a post-filter fed with an encoded and subsequently decoded speech signal is updated with a sub-frame period, while the gain of a gain adjustment circuit for correcting gain changes caused by the spectral shaping is updated with a frame period that is eight times as long as the sub-frame period. This achieves switching of the filter coefficient so as to be changed smoothly with a higher follow-up speed, while suppressing level changes otherwise caused by frequent gain switching. The result is improved characteristics of a post-filter used for spectral shaping of a decoded signal supplied from the signal decoder and more effective post-filter processing.

12 Claims, 10 Drawing Sheets

SPEECH DECODING METHOD AND APPARATUS

BACKGROUND OF THE INVENTION

Field of the Invention

This invention relates to a speech decoding method and apparatus for decoding and subsequently post-filtering input speech signals.

DESCRIPTION OF THE BACKGROUND

There have hitherto been known a variety of encoding methods for encoding an audio signal, which includes speech and acoustic signals, using compression that exploit the statistic properties of the signals in the time domain and in the frequency domain and that also utilize the psychoacoustic characteristics of the human hearing physiology. These encoding methods may roughly be classified into time-domain encoding, frequency domain encoding, and analysis/synthesis encoding.

In addition, there are known methods for high-efficiency encoding of speech signals that include sinusoidal analysis encoding, such as harmonic encoding, multi-band excitation (MBE) encoding, sub-band coding (SBC), linear predictive coding (LPC), discrete cosine transform (DCT), modified DCT (MDCT), and fast Fourier transform (FFT).

Post-filters are sometimes used after decoding these encoded signals to provide spectral shaping and to improve the psychoacoustic signal quality.

When updating the filter characteristics responsive to an input, if the updating period is prolonged, the post filter characteristics cannot follow short-term changes in the speech spectrum, so that smooth and optimum improvement in signal quality cannot be achieved. Moreover, if the updating period is short, level changes become severe and audible click noises tend to be produced.

SUMMARY OF THE INVENTION

It is therefore an object of the present invention to provide a speech decoding method and apparatus, whereby a satisfactory decoded output and a high-quality playback sound can be produced even when decoding speech that was encoded with a relatively fewer number of bits.

According to one aspect of the present invention, the filter coefficient of a spectral shaping filter to which an encoded speech signal is supplied after decoding is updated within a first period, while the variable gain used for correcting gain changes caused by the spectral shaping is updated within a period that is different than the first period.

In this case, by shortening the first period, which is the updating period of the filter coefficient of the spectral shaping filter, and by elongating the second period, which is the gain updating period for the gain adjustment, it becomes possible to effect switching of the smoothly changed filter coefficient with a high follow-up rate and to suppress sudden level changes otherwise caused by frequent gain switching.

With the speech decoding method according to the present invention, the updating period used for updating the filter coefficient of a spectral shaping filter of a post filter used for a decoder of the speech coder/decoder (codec) is set to be different than the updating period used for updating the gain value that provides gain adjustment for correcting gain changes otherwise caused by spectral shaping. Moreover, the updating period for updating the gain value for gain adjustment is set to be longer than the period for updating the spectral shaping filter, thereby assuring more effective post-filter processing.

More specifically, if a long updating period for the filter coefficient of the spectral shaping filter in a post filter is used, then post-filter characteristics cannot cope with short-term changes in the speech spectrum, thereby deteriorating the quality of the output speech. Taking this into consideration, it may be contemplated to update the filter coefficient within a short period, however, if the gain value for adjustment is updated in a correspondingly short period, there may be occasions where the gain value for gain adjustment is significantly changed within a one-pitch period given the pitch and peak phase conditions, thereby producing the undesirable click noise. Therefore, according to the present invention the filter coefficient updating period and the gain value updating period are shortened and elongated, respectively, for suppressing gain variations and realizing optimum post filtering.

DETAILED DESCRIPTION OF THE PREFERRED EMBODIMENTS

Figure 1:
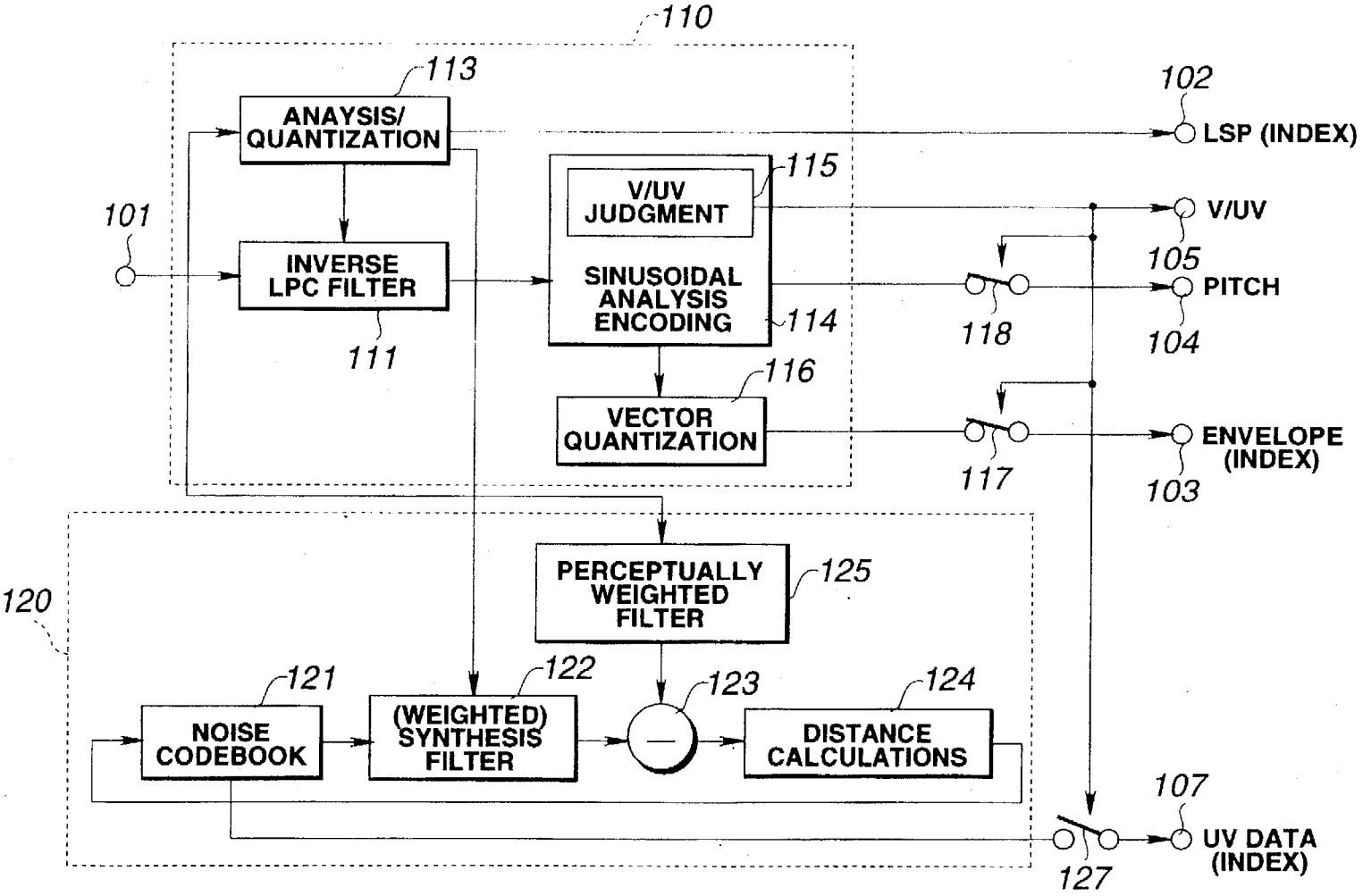
FIG. 1 is a block diagram of a speech encoding apparatus for producing encoded speech signals to be fed to a speech decoding apparatus according to an embodiment of the present invention.

Before describing a preferred embodiment of the present invention, the speech encoding apparatus and the speech decoding apparatus, forming an example of the speech codec according to the present invention, will be explained by referring to the drawings.

A basic concept of the speech signal encoder of FIG. 1 is that the encoder has a first encoding unit 110 for finding short-term prediction residuals or errors, such as linear prediction encoding (LPC) residuals, of the input speech signal for performing sinusoidal analysis encoding, such as harmonic coding, and has a second encoding unit 120 for encoding the input speech signals by waveform coding exhibiting phase reproducibility. These first and second encoding units 110, 120 are used for encoding the voiced portion and unvoiced portion of the input signal, respectively. It being understood, of course, that voiced portion means those sounds or letters that have a spectral distribution and unvoiced portion means those sounds or letters that look like noise.

The first encoding unit 110 performs encoding of the LPC residuals with sinusoidal analytic encoding, such as harmonics encoding or multi-band encoding (MBE). The second encoding unit 120 performs code excitation linear prediction (CELP) employing vector quantization by a closed loop search for an optimum vector employing an analysis-by-synthesis method.

In this embodiment, the speech signal supplied at an input terminal 101 is fed to an inverse LPC filter 111 and to an LPC analysis/quantization unit 113 of the first encoding unit 110. The LPC coefficient obtained from the LPC analysis/quantization unit 113, which is the so-called α-parameter, is fed to the inverse LPC filter 111 for taking out the linear prediction residuals (LPC residuals) of the input speech signals by the inverse LPC filter 111. From the LPC analysis/quantization unit 113, a quantization output of the linear spectral pairs (LSP), as explained hereinafter, is taken out and fed to an output terminal 102. The LPC residuals or errors from the inverse LPC filter 111 are fed to a sinusoidal analysis encoding unit 114. The sinusoidal analysis encoding unit 114 performs pitch detection, spectral envelope amplitude calculations and V/UV discrimination by a voiced (V)/unvoiced (UV) judgement unit 115. The spectral envelope amplitude data from the sinusoidal analysis encoding unit 114 are fed to a vector quantization unit 116. The envelope index from the vector quantization unit 116, which is a vector quantization output of the spectral envelope, is sent via a switch 117 to an output terminal 103, while a pitch output of the sinusoidal analysis encoding unit 114 is sent via a switch 118 to an output terminal 104. The V/UV discrimination output from the V/UV discrimination unit 115 is fed out at an output terminal 105 and is used to control the switches 117, 118. Thus, for the voiced (V) signal, the index and the pitch are taken out at the output terminals 103, 104 respectively.

In the present embodiment, the second encoding unit 120 of FIG. 1 has a code excitation linear prediction (CELP) encoding configuration, and performs vector quantization of the time-domain waveform employing the closed-loop search by the analysis-by-synthesis method, in which an output of a noise codebook 121 is synthesized by a weighted synthesis filter 122. The resulting weighted speech signal is fed to one input of a subtractor 123, where an error between the weighted speech signal from filter 122 and the speech signal that was supplied to the input terminal 101 after having been passed through a perceptually weighted filter 125 is derived and fed to a distance calculation circuit 124 in order to perform distance calculations. The output of the distance calculation circuit 124 is fed back to the noise codebook 121 to search for a vector that minimizes the error. This CELP encoding is used for encoding the unvoiced portion of the input signal at terminal 101 as described above. The codebook index forming the UV data from the noise codebook 121 is taken out at an output terminal 107 via a switch 127, which is closed when the results of the V/UV discrimination from the V/UV judgement unit 115 indicate an unvoiced (UV) sound.

Figure 2:
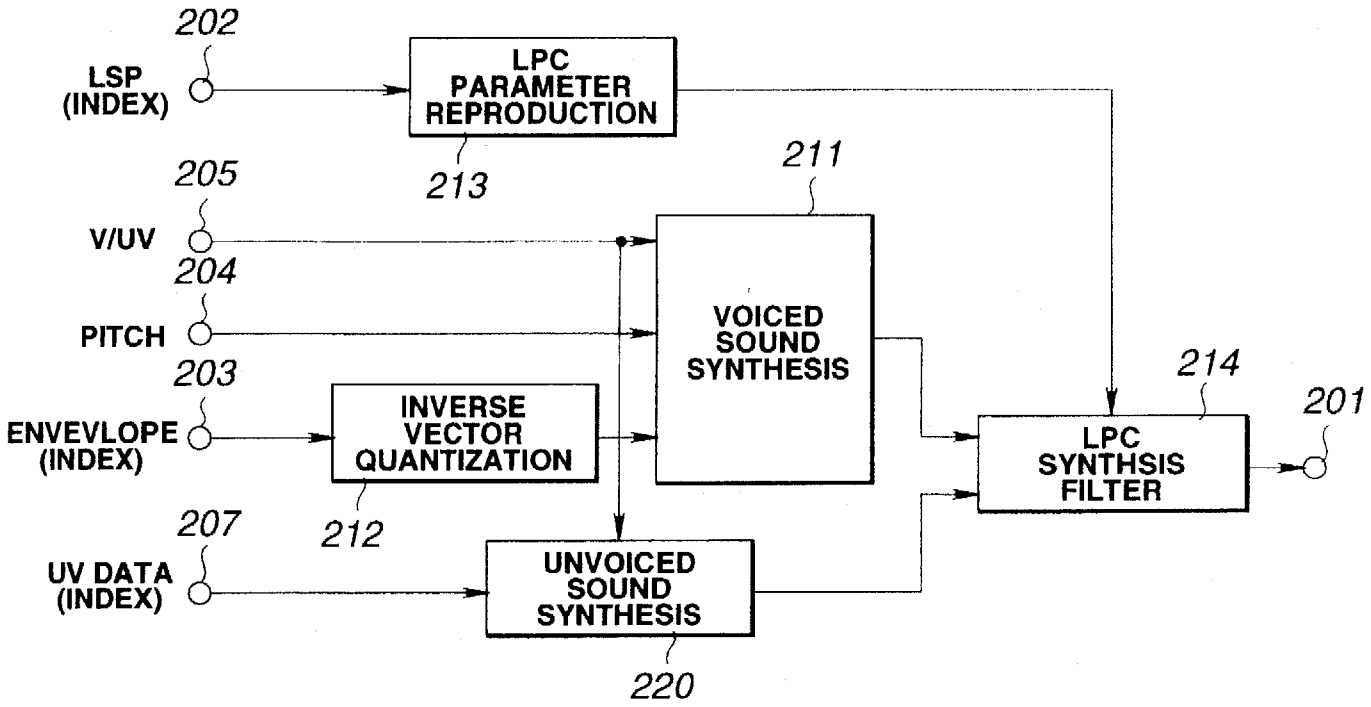
FIG. 2 is a block diagram of a speech decoding apparatus for carrying out the speech decoding method according to an embodiment of the present invention.

FIG. 2 is a block diagram of a speech signal decoder, as a counterpart device to the speech signal encoder shown in FIG. 1, for carrying out the speech decoding method according to this embodiment of the present invention.

Referring to FIG. 2, a codebook index as a quantization output of the linear spectral pairs (LSPs) from the output terminal 102 of FIG. 1 is supplied to an input terminal 202. The signals at the output terminals 103, 104, and 105 of FIG. 1, that is, the index data, the pitch, and the V/UV discrimination output, as the envelope quantization outputs are supplied to input terminals 203, 204, and 205, respectively. The index data forming data for the unvoiced data are supplied from the output terminal 107 of FIG. 1 to an input terminal 207.

The envelope index forming the quantization output at the input terminal 203 is fed to an inverse vector quantization unit 212 for inverse vector quantization to find a spectral envelope of the LPC residues or errors. The output of the inverse vector quantitization unit 212 is fed to a voiced speech synthesizer 211 that synthesizes the linear prediction encoding (LPC) residuals of the voiced speech portion by sinusoidal synthesis. The voiced speech synthesizer 211 also receives the pitch and the V/UV discrimination output from the input terminals 204, 205. The LPC residuals of the voiced speech from the voiced speech synthesis unit 211 are fed to an LPC synthesis filter 214. The index data of the UV data at input terminal 207 is fed to an unvoiced sound synthesis unit 220, which also received the V/UV discrimination signal, where reference is had to the output of the noise codebook 121 for taking out the LPC residuals of the unvoiced portion. These LPC residuals are also fed to the LPC synthesis filter 214.

In the LPC synthesis filter 214, the LPC residuals of the voiced portion and the LPC residuals of the unvoiced portion are processed by LPC synthesis. Alternatively, in place of the LPC synthesis filter 214 the LPC residuals of the voiced portion and the LPC residuals of the unvoiced portion may be summed and processed with LPC synthesis. The LSP index data at the input terminal 202 is fed to LPC parameter reproducing unit 213 where α-parameters of the LPC are taken out and used in the LPC synthesis filter 214. The speech signals synthesized by the LPC synthesis filter 214 are fed out at an output terminal 201.

Figure 3:
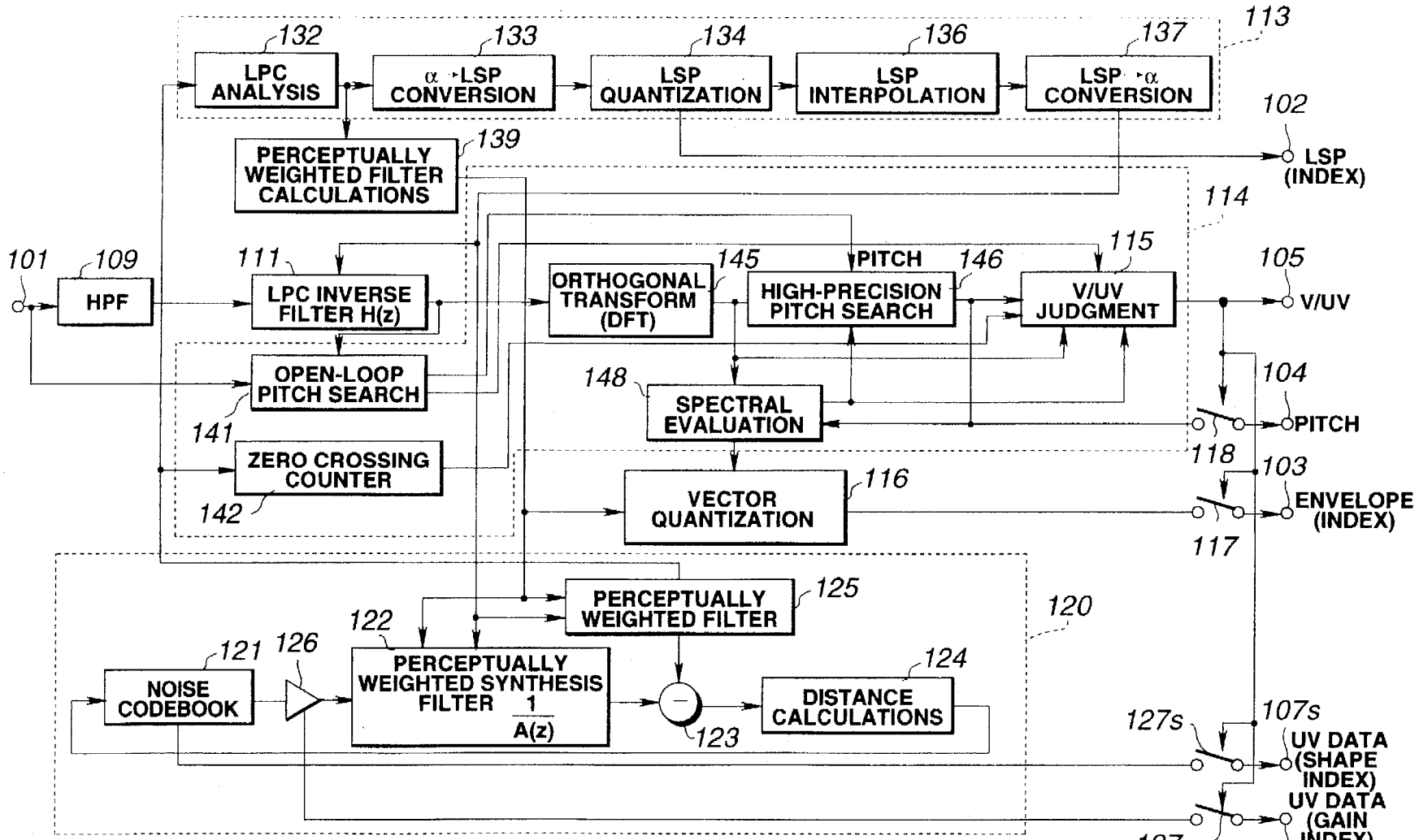
FIG. 3 is a block diagram showing in more detail the structure of the speech signal encoding apparatus shown in FIG. 1.

A more detailed structure of the speech signal encoder shown in FIG. 1 is shown in FIG. 3, in which the parts or components similar to those shown in FIG. 1 are denoted by the same reference numerals.

In the speech signal encoder shown in FIG. 3, the speech signals supplied to the input terminal 101 are filtered by a high-pass filter 109 for removing unneeded low-frequency signals and thence supplied to an LPC analysis circuit 132 of the LPC analysis/quantization unit 113 and also to the inverse LPC filter 111. The LPC analysis circuit 132 of the LPC analysis/quantization unit 113 applies a Hamming window, with a length of the input signal waveform on the order of 256 samples as a block, and finds a linear prediction coefficient, which is the so-called α-parameter, by the self-correlation method. The framing interval as a data output unit is set to approximately 160 samples. If the sampling frequency (fs) is 8 kHz, for example, a one-frame interval is 20 msec for 160 samples.

The α-parameter from the LPC analysis circuit 132 is fed to an α-LSP conversion circuit 133 for conversion into line spectra pair (LSP) parameters. This circuit converts the α-parameter, as found by the direct-type filter coefficient in the LPC analysis unit 132, for example, into ten parameters, that is, five pairs of the LSP parameters. This conversion is carried out by the Newton-Rhapson method, for example. The reason the α-parameters are converted into the LSP parameters is that the LSP parameter is superior in interpolation characteristics to the α-parameter.

The LSP parameters from the α-LSP conversion circuit 133 are matrix quantizied or vector quantized by the LSP quantization circuit 134. Alternatively, it is possible to take a frame-to-frame difference prior to vector quantization, or to collect plural frames in order to perform matrix quantization. In the present case, two frames (20 msec per frame interval) of the LSP parameters, calculated every 20 msec, are collected and processed with matrix quantization and vector quantization.

The quantized output of the LSP quantization circuit 134, which is the index data of the LSP quantization, are fed out at the output terminal 102, while the quantized LSP vector is fed to an LSP interpolation circuit 136.

The LSP interpolation circuit 136 interpolates the LSP vectors, quantized every 20 msec or 40 msec, in order to provide an eight-fold rate. That is, the LSP vector is updated every 2.5 msec, and the reason for this is that if the residual waveform is processed with the analysis/synthesis by the harmonic encoding/decoding method, the envelope of the synthetic waveform presents an extremely smooth waveform. In other words, if the LPC coefficients are changed abruptly every 20 msec a foreign noise is likely to be produced, whereas if the LPC coefficient is changed gradually every 2.5 msec, such foreign noise may be prevented from occurring.

For inverse filtering of the input speech using the interpolated LSP vectors produced every 2.5 msec, the LSP parameters are converted by an LSP to α conversion circuit 137 into α-parameters that are the coefficients of a ten-order direct-type filter, for example. An output of the LSP to α conversion circuit 137 is sent to the inverse LPC filter circuit 111, which then performs inverse filtering for producing a smooth output using an α-parameter that is updated every 2.5 msec. The output of the inverse LPC filter 111 is fed to an orthogonal transform circuit 145, such as a DFT circuit, of the sinusoidal analysis encoding unit 114, which is an harmonic encoding circuit.

The α-parameter from the LPC analysis circuit 132 of the LPC analysis/quantization unit 113 is also fed to a perceptual weighting filter calculation circuit 139 where data for perceptual weighting is found. These weighting data are sent to a perceptual weighting vector quantization circuit 116, to the perceptually by weighted filter 125 of the second encoding unit 120, and to the perceptually weighted synthesis filter 122.

The sinusoidal analysis encoding unit 114 of the harmonic encoding circuit analyzes the output of the inverse LPC filter 111 by a method of harmonic encoding. That is, pitch detection, calculations of the amplitudes Am of the respective harmonics, and voiced (V)/unvoiced (UV) discrimination are carried out and the numbers of the amplitudes Am or the envelopes of the respective harmonics, varied with the pitch, are made constant by dimensional conversion.

In an illustrative example of the sinusoidal analysis encoding unit 114 shown in FIG. 3, commonplace harmonic encoding is used. In particular, in multi-band excitation (MBE) encoding, it is assumed in modeling that voiced portions and unvoiced portions are present in the frequency area or band at the same time point, that is, in the same block or frame. In other harmonic encoding techniques, it is uniquely judged whether the speech in one block or in one frame is voiced or unvoiced. In the following description, a given frame is judged to be UV if the totality of the band is UV, insofar as the MBE encoding is concerned.

An open-loop pitch search unit 141 and a zero-crossing counter 142 of the sinusoidal analysis encoding unit 114 of FIG. 3 are fed with the input speech signal from the input terminal 101 and with the signal from the high-pass filter (HPF) 109, respectively. The orthogonal transform circuit 145 of the sinusoidal analysis encoding unit 114 is supplied with LPC residuals or linear prediction residuals from the inverse LPC filter 111. The open loop pitch search unit 141 takes the LPC residuals of the input signals to perform a relatively rough pitch search by an open loop method. The extracted rough pitch data is sent to a high-precision pitch search unit 146, whose operation is explained below. From the open loop pitch search unit 141, the maximum value of the normalized self correlation r(p), which is obtained by normalizing the maximum value of the self-correlation of the LPC residuals along with the rough pitch data, is taken out along with the rough pitch data and fed to the V/UV judgement unit 115.

The orthogonal transform circuit 145 performs an orthogonal transform, such as a discrete Fourier transform (DFT), for converting the LPC residuals on the time axis into spectral amplitude data on the frequency axis. The output of the orthogonal transform circuit 145 is fed to the fine pitch search unit 146 and to a spectral evaluation unit 148 for evaluating the spectral amplitude or envelope.

The high-precision pitch search unit 146 is fed with relatively rough pitch data extracted by the open loop pitch search unit 141 and with frequency-domain data obtained by DFT in the orthogonal transform unit 145. The fine pitch search unit 146 swings the pitch data by plus or minus several samples, at a rate of 0.2 to 0.5, centered about the rough pitch value data, in order to arrive ultimately at the value of the high-precision pitch data having an optimum decimal point (floating point). The analysis-by-synthesis method is used as the high precision search technique for selecting a pitch, so that the power spectrum will be closest to the power spectrum of the original sound. Pitch data from the closed-loop high-precision pitch search unit 146 is sent to the output terminal 104 via the switch 118.

In the spectral evaluation unit 148, the amplitude of each of the harmonics and the spectral envelope as the sum of the harmonics are evaluated based on the spectral amplitude and the pitch as the orthogonal transform output of the LPC residuals and sent to the high-precision pitch search unit 146, to the V/UV judgement unit 115 and the perceptually weighted vector quantization unit 116.

The V/UV judgement unit 115 discriminates V/UV for a frame based on an output of the orthogonal transform circuit 145, on optimum pitch from the high precision pitch search unit 146, on spectral amplitude data from the spectral evaluation unit 148, on a maximum value of the normalized self-correlation r(p) from the open loop pitch search unit 141, and on the zero-crossing count value from the zero-crossing counter 142. In addition, the boundary position of the band-based V/UV discrimination for the MBE may also be used as a condition for V/UV discrimination . The discrimination output of the V/UV discrimination unit 115 is fed out at the output terminal 105.

An output unit of the spectral evaluation unit 148 or an input unit of the vector quantization unit 116 is provided with a data number conversion unit, not shown, which is a unit performing a sort of sampling rate conversion. Such a data number conversion unit is used for setting the amplitude data |Am| of an envelope, taking into account the fact that the number of bands that are split on the frequency axis and the number of data differ with the pitch. That is, if the effective band is up to 3400 kHz, the effective band can be split into from 8 to 63 bands depending on the pitch. The number of mMX+1 of the amplitude data |Am|, obtained from band to band, is changed in the range from 8 to 63. Thus, the data number conversion unit included as an output unit in the spectral evaluation unit 148 or as an input unit of the vector quantization unit 116 converts the amplitude data of the variable number mMx+1 to a pre-set number M of data, such as 44.

The amplitude data or envelope data of the pre-set number M, such as 44 in this example, from the data number conversion unit, provided at an output unit of the spectral evaluation unit 148 or at an input unit of the vector quantization unit 116, are collected in terms of a pre-set number of data units, such as 44, by the vector quantization unit 116, by way of performing weighted vector quantization. This weighting is supplied to the vector quantizing unit 116 by an output of the perceptually weighted filter calculation circuit 139. The index of the envelope from the vector quantization circuit 116 is taken out through the switch 117 at the output terminal 103. Prior to weighted vector quantization, it is advisable to take the inter-frame difference using a suitable leakage coefficient for a vector made up of a pre-set number of data.

An illustrative arrangement for data number conversion for providing a constant number of data of the amplitude of the spectral envelope on an output side of the spectral evaluating unit 148 or on an input side of the vector quantization unit 116 is now explained.

A variety of methods may be conceived for such data number conversion. In the present embodiment, dummy data interpolating the values from the last data in a block to the first data in the block or other pre-set data, such as data repeating the last data or the first data in a block, are appended to the amplitude data of one block of an effective band on the frequency axis for enhancing the number of data to N. Amplitude data equal in number to Os times, such as eight times, are found by Os-fold, such as eight-fold over-sampling of the limited bandwidth type using, for example, an FIR filter. The (mMx+1)×Os amplitude data are linearly interpolated for expansion to a larger $N_M$ number, such as 2048. This $N_M$ data is sub-sampled for conversion to the above-mentioned pre-set number M of data, such as 44.

The second encoding unit 120 shown in FIG. 3 has a so-called CELP encoding structure and is used in particular for encoding the unvoiced portion of the input speech signal. In the CELP encoding structure for the unvoiced portion of the input speech signal, a noise output corresponding to the LPC residuals of the unvoiced sound as a representative value output of the noise codebook 121, or a so-called stochastic codebook, is fed through a gain control circuit 126 to the perceptually weighted synthesis filter 122. The weighted synthesis filter 122 LPC synthesizes the input noise and sends the produced weighted unvoiced signal to one input of the subtractor 123. The subtractor 123 receives at the other input the signal supplied at the input terminal 101 via the high-pass filter (HPF) 109 after having been perceptually weighted by the perceptually weighted filter 125. The difference or error between the input signal and the signal from the synthesis filter 122 is formed at the output of the subtractor 123. Meanwhile, a zero input response from the perceptually weighted synthesis filter 122 was previously subtracted from the output of the perceptual weighting filter output 125. This error from the subtractor 123 is fed to the distance calculation circuit 124 for calculating the distance that is used to search for a representative vector value that will minimize the error in the noise codebook 121.

The above discussion is a summary of the vector quantization of the time-domain waveform employing the closed-loop search, which in turn employs the analysis-by-synthesis method.

As data representing the unvoiced (UV) portion from the second encoder 120 employing the CELP coding structure, the shape index of the codebook from the noise codebook 121 and the gain index of the codebook from the gain circuit 126 are output. More specifically, the shape index, which is the UV data from the noise codebook 121, is fed out through switch 127*s* to an output terminal 107*s*, and the gain index, which is the UV data from the gain circuit 126, is sent via a switch 127*g* to an output terminal 107*g*.

These switches 127*s*, 127*g* and the switches 117, 118 are all turned on and off in response to the results of the V/UV decision from the V/UV judgement unit 115. Specifically, the switches 117, 118 are turned on, if the results of V/UV discrimination of the speech signal of the frame currently transmitted indicates voiced (V), whereas the switches 127*s*, 127*g* are turned on if the speech signal of the frame currently transmitted is unvoiced (UV).

Figure 4:
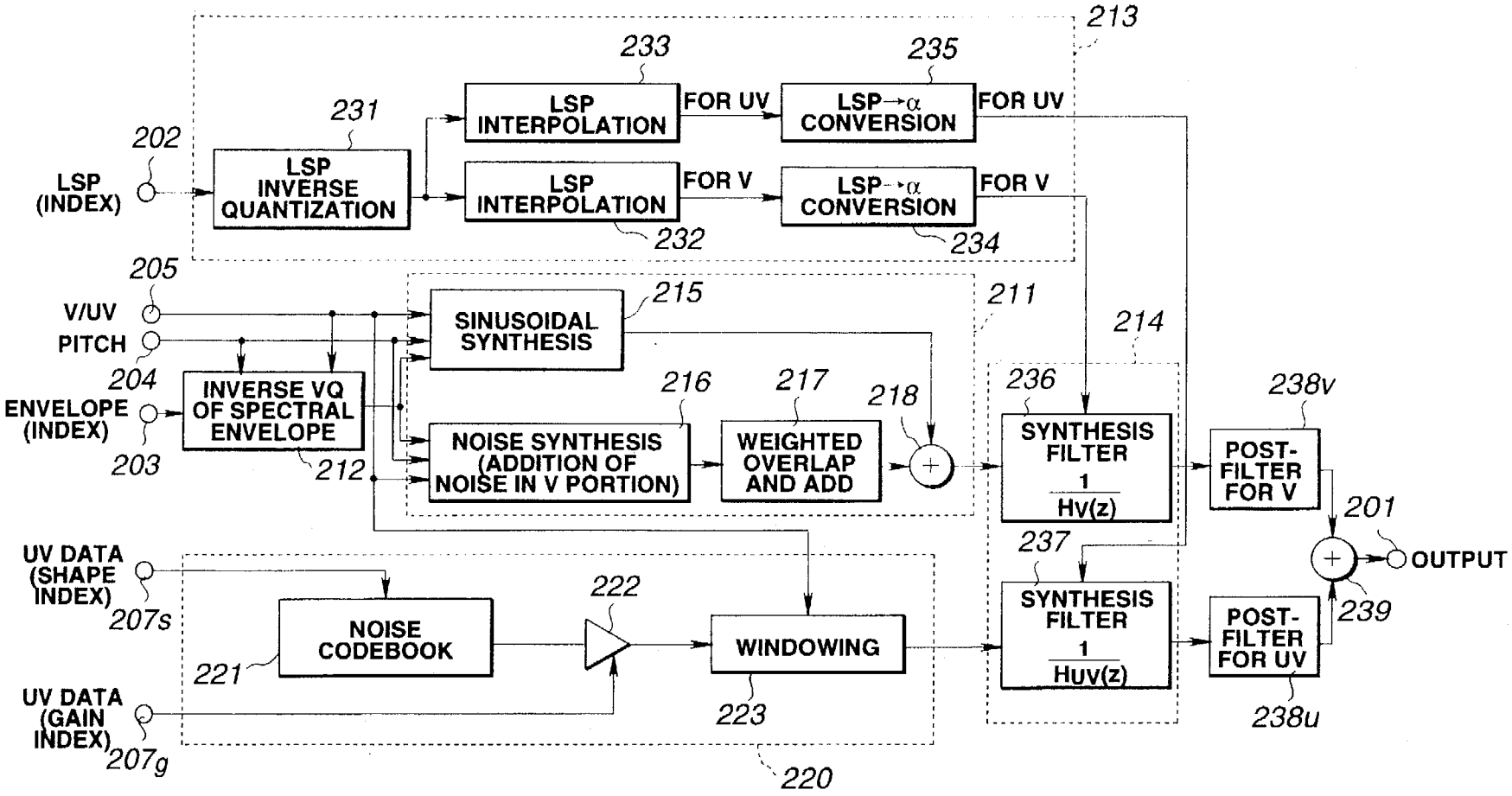
FIG. 4 is a block diagram of the speech signal decoding apparatus according to an embodiment of the present invention.

FIG. 4 shows in more detail the structure of the speech signal decoder shown in FIG. 2, in which the same numerals are used to denote the same components shown in FIG. 2.

In FIG. 4, a vector quantization output of the LSP index corresponding to the output terminal 102 of FIGS. 1 and 3, which is the codebook index, is supplied to the input terminal 202.

The LSP index at input 202 is fed to an inverse vector quantization circuit 231 of the LPC parameter reproducing unit 213 so as to be inverse vector quantized to line spectral pair (LSP) data that are then supplied to LSP interpolation circuits 232, 233 for interpolation. The resulting interpolated data output from circuits 232, 233 is converted by respective LSP-to-α conversion circuits 234, 235 to α parameters that are then fed to the LPC synthesis filter 214. The LSP interpolation circuit 232 and the LSP-to-α conversion circuit 234 are designed for voiced (V) sound, whereas the LSP interpolation circuit 233 and the LSP-to-α conversion circuit 235 are designed for unvoiced (UV) sound.

The LPC synthesis filter 214 is separated into an LPC synthesis filter 236 for the voiced speech portion and an LPC synthesis filter 237 for the unvoiced speech portion. That is, LPC coefficient interpolation is carried out independently for the voiced speech portion and the unvoiced speech portion, thereby prohibiting ill effects which might otherwise be produced in the transition portion from the voiced speech portion to the unvoiced speech portion, or vice versa, by interpolation of the LSPs of totally different properties.

The input terminal 203 of FIG. 4 is supplied with index data representing the weighted vector quantized spectra envelope Am corresponding to the output of the terminal 103 of the encoder of FIGS. 1 and 3. The input terminal 204 is supplied with the pitch data from the terminal 104 of FIGS. 1 and 3, and the input terminal 205 is supplied the V/UV discrimination data from the terminal 105 of FIGS. 1 and 3.

The vector-quantized index data of the spectral envelope Am from the input terminal 203 is fed to the inverse vector quantization circuit 212 for inverse vector quantization, where inverse conversion with respect to the data number conversion is carried out. The resulting spectral envelope data is fed to a sinusoidal synthesis circuit 215.

If the inter-frame difference is found prior to vector quantization of the spectrum during encoding, the inter-frame difference is decoded after inverse vector quantization for producing the spectral envelope data.

The sinusoidal synthesis circuit 215 is fed with the pitch data from the input terminal 204 and the V/UV discrimination data from the input terminal 205. The sinusoidal synthesis circuit 215 produces the LPC residual data, corresponding to the output of the LPC inverse filter 111 shown in FIGS. 1 and 3, that is fed to one input of an adder 218.

The envelope data of the inverse vector quantization circuit 212 and the pitch and the V/UV discrimination data from the input terminals 204, 205 are also fed to a noise synthesis circuit 216 for adding noise to the voiced portion (V). The output of the noise synthesis circuit 216 is fed to another input of the adder 218 via a weighted overlap-add circuit 217. That is, such noise is added to the voiced portion of the LPC residual signals to take into account the fact that, because the excitation as an input to the LPC synthesis filter of the voiced sound is produced by sine wave synthesis, a stuffed feeling is produced in low-pitched sounds, such as male speech, and the sound quality is abruptly changed between the voiced sound and the unvoiced sound, thereby producing an unnatural auditory feeling. Such noise takes into account the parameters concerned with speech encoding data, such as pitch, amplitudes of the spectral envelope, maximum amplitude in a frame or the residual signal level, in connection with the LPC synthesis filter input of the voiced speech portion, that is, excitation.

The summed output of the adder 218 is fed to the synthesis filter 236 for the voiced sound of the LPC synthesis filter 214 where LPC synthesis is carried out to form time waveform data which then is filtered by a post-filter **238*v* for the voiced speech and fed to one input of an adder 239. The post-filter 238*v*** for voiced sound shortens the update period of the filter coefficient of the internal spectral shaping filter to 20 samples or 2.5 msec, while elongating the gain update period of the gain adjustment circuit to 160 samples or 20 msec, as will be explained hereinbelow.

The shape index and the gain index, as UV data from the output terminals **107*s* and 107*g* of FIG. 3, are supplied to the input terminals 207*s* and 207*g* of FIG. 4, respectively, and thence supplied to the unvoiced speech synthesis unit 220. The UV shape index from the terminal 207*s* is fed to the noise codebook 221 of the unvoiced speech synthesis unit 220, while the UV gain index from the terminal 207*g* is fed to the gain circuit 222. The representative value output read out from the noise codebook 221 is a noise signal component corresponding to the LPC residuals of the unvoiced speech. This output is gain controlled in the gain circuit 222 and is sent to a windowing circuit 223, so as to be windowed for smoothing the junction to the voiced speech portion. The output of the windowing circuit 223 is fed to the synthesis filter 237 for the unvoiced (UV) speech of the LPC synthesis filter 214 as the output of the unvoiced speech synthesis unit 220. The data sent to the synthesis filter 237 is processed with LPC synthesis to become time waveform data for the unvoiced portion. The time waveform data of the unvoiced portion is filtered by a post-filter 238*u* for the unvoiced portion before being fed to another input of the adder 239. The post-filter 238*u* for unvoiced sound also shortens the update period of the filter coefficient of the internal spectral shaping filter to 20 samples or 2.5 msec, while elongating the gain update period of the gain adjustment circuit to 160 samples or 20 msec, as explained below. Alternatively, the updating frequency of the spectra shaping filter coefficient may be matched to that of the LPC synthesis filter for UV of the synthesis filter 237** insofar as the unvoiced speech is concerned.

In the adder 239, the time waveform signal from the post-filter for the voiced speech **238*v* and the time waveform data for the unvoiced speech portion from the post-filter for the unvoiced speech 238*u* are added to each other and the resulting summed data is taken out at the output terminal 201**.

The detailed structure and operation of the speech signal decoder of FIG. 4 are now explained. The LPC synthesis filter 214 is divided into the synthesis filter for voiced sound (V) 236 and the synthesis filter for unvoiced sound (UV) 237, as explained previously. That is, if the synthesis filter is not split and LSP interpolation is continuously performed without making distinction between V and UV every 20 samples, that is every 2.5 msec, then the LSPs of totally different properties are interpolated at the V to UV and UV to V transient portions, so that the LPC of UV would be used for the residuals of V and the LPC of V would be used for the residuals of UV with the result that a foreign sound is produced. In order to avoid these ill effects, the LPC synthesis filter is separated into a filter for V and a filter for UV and filter interpolation for UV and LPC coefficients is performed independently for V and UV.

The method for coefficient interpolation of the LPC filters 236, 237 is now explained. The LSP interpolation is switched depending on the V/UV state, as shown in Table 1.

TABLE 1

| | Hv(z) | | Huv (z) | |
|---|---|---|---|---|
| | previous frame | current frame | previous frame | current frame |
| V to V | transmitted LSP | transmitted LSP | equal interval LSP | equal interval LSP |
| V to UV | transmitted LSP | equal interval LSP | equal interval LSP | transmitted LSP |
| UV to V | equal interval LSP | transmitted LSP | transmitted LSP | equal interval LSP |
| UV to UV | equal interval LSP | equal interval LSP | transmitted LSP | transmitted LSP |

In Table 1, the equal interval LSP in case of 10-order LPC analysis means the LSP associated with α-parameters for flat filter characteristics and gain equal to unity, that is, $\alpha 0=1$, $\alpha 1=\alpha 2=\ldots \alpha 10=0$, so that $LSPi=(\pi/11)\times i$, where $0\leqq i\leqq 10$.

Figure 5:
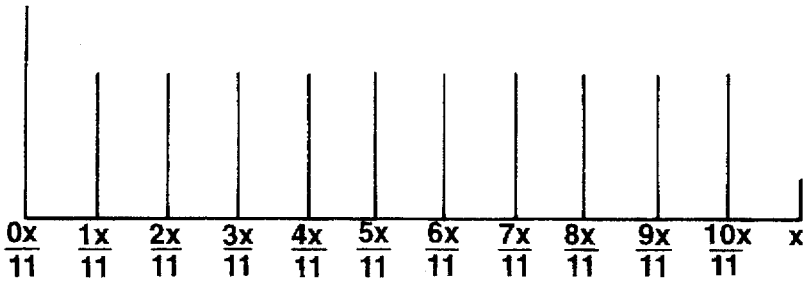
FIG. 5 shows a ten-order linear spectral pair (LSP) derived from an α-parameter obtained by 10-order linear predictive coding (LPC) analysis.

For the 10-order LPC analysis, that is 10-order LSP, the LSPs are equally arrayed at different positions obtained by equally dividing the interval between 0 and π corresponding to a completely flat spectrum, as shown in FIG. 5. The full-range gain of the synthesis filter presents minimum through characteristics.

Figure 6:
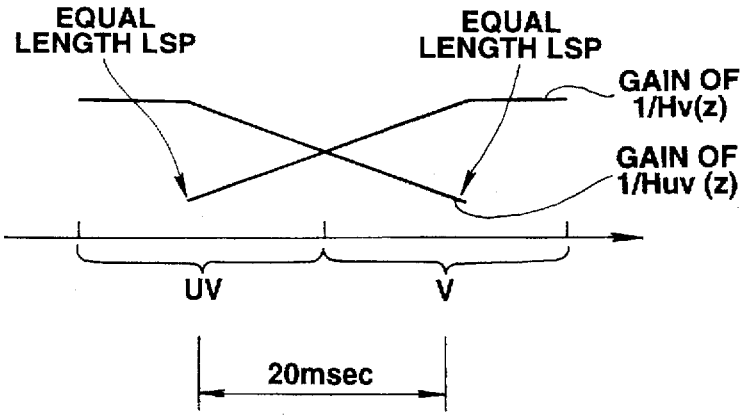
FIG. 6 illustrates the manner in which gain changes from an unvoiced (UV) frame to a voiced (V) frame.

FIG. 6 schematically shows the manner in which the gain changes. That is, FIG. 6 shows how the gain of 1/Huv(z) and the gain for 1/Hv(z) are changed during transition from the unvoiced (UV) portion to the voiced (V) portion.

If the frame interval is 160 samples or 20 msec, the coefficient for 1/Hv(z) is interpolated every 2.5 msec or every 20 samples, while the coefficient for 1/Huv(z) is 10 msec (80 samples) and 5 msec (40 samples) for the bit rates of 2 kbps and 6 kbps, respectively. For UV, waveform matching is done with the aid of the analysis-by-synthesis method by the second encoding unit 120 on the encoder side, so that interpolation can be done with the LSPs of the neighboring UV portion instead of with the equal interval LSPs. In the UV encoding in the second encoding unit 120, the zero input response is set to zero by clearing the internal state of the weighted synthesis filter 122 of 1/A(z) at the transition portion from V to UV.

Outputs of these LPC synthesis filters 236, 237 are respectively sent to independently provided post-filters 238*v*, 238*u*. By post-filtering independently for V and UV, the intensity and frequency response of the post-filters can be set to different values for V and UV.

The windowing for the junction portion between the V and UV portions of the LPC residual signals, that is, the excitation as an LPC synthesis filter input, is explained below. This windowing is performed by the sine wave synthesis circuit 215 of the voiced sound synthesis unit 211 and a windowing circuit 223 of the unvoiced sound synthesis unit 220.

Figure 7:
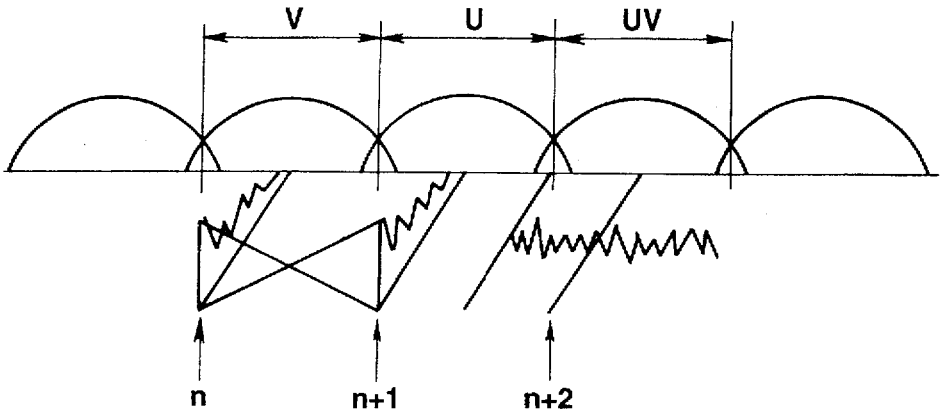
FIG. 7 illustrates interpolation of a waveform synthesized on a frame basis.
Figure 8:
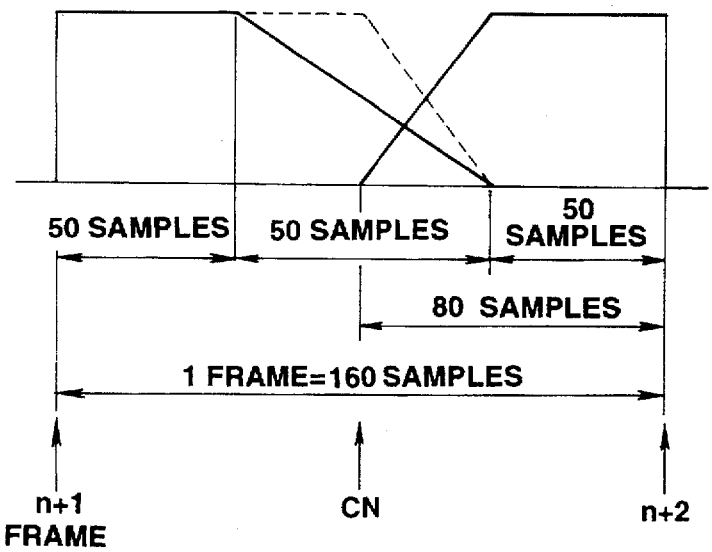
FIG. 8 illustrates overlap at a junction between a voiced (V) frame and an unvoiced (UV) frame.

For the voiced (V) portion, since the spectral components are interpolated using the spectral components of the neighboring frames, all waveforms across the n'th and the (n+1)st frames can be produced, as shown in FIG. 7. For a portion lying across the V and UV frames, such as the (n+1)st frame and (n+2)nd frame in FIG. 7, however, only data of ±80 samples in the frame are encoded and decoded. It should be noted that in this example 160 samples make up one frame interval, as shown in FIG. 8. To this end, windowing is done beyond the center point CN between the frames on the V side, while it is done as far as the center point CN on the UV side, with an overlap at the connecting portion, as shown in FIG. 8. The reverse operation is done on the UV to V transient portion. Alternatively, the windowing on the V side could also be done as indicated by the broken line in FIG. 8.

The noise synthesis and noise addition for the voiced (V) portion will be explained below. To this end, using the noise synthesis circuit 216, the weighted overlap circuit 217, and the adder 218 of FIG. 4, noise that takes into account the following parameters is added to the voiced portion of the LPC residual signals for the excitation, and the combined signal becomes the LPC filter input for the voiced portion.

These parameters include the pitch lag Pch, spectral amplitudes of the voiced sound Am[i], maximum spectral amplitude in the frame Amax, and the level Lev of the residual signals. The pitch lag Pch is the number of samples in the pitch period for a pre-set sampling frequency fs, such as 8 kHz, whereas I in the spectral amplitude Am[i] is an integer such that 0<I<I, where I is the number of harmonics in the band of fs/2 (I=Pch/2).

Figure 9:
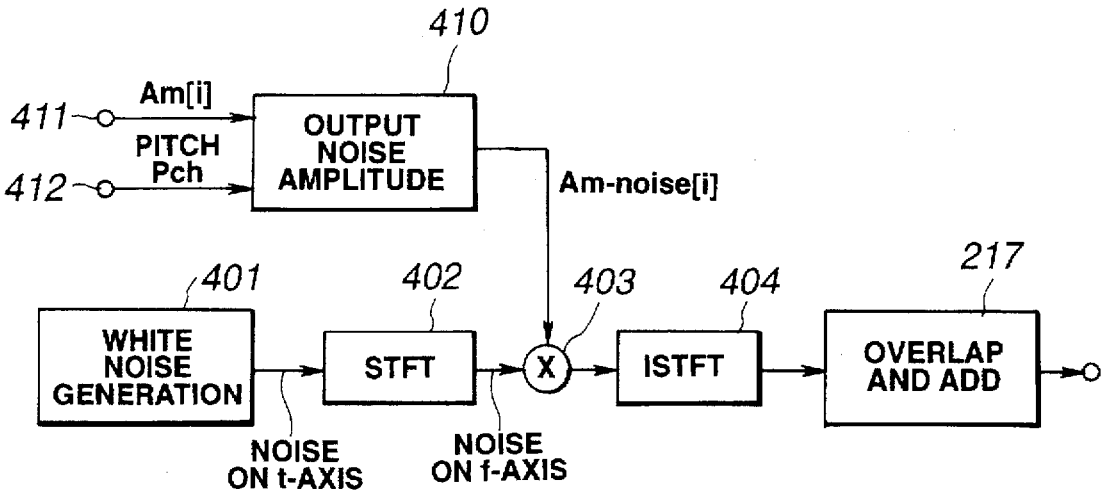
FIG. 9 is a block diagram of a noise addition circuit for adding noise at the time of synthesis of the voiced sound.

The processing by the noise synthesis circuit 216 is performed in a similar manner to the synthesis of the unvoiced sound for MBE. FIG. 9 shows an illustrative example of the noise synthesis circuit 216. In the circuit of FIG. 9, a Gaussian noise generator 401 outputs Gaussian noise corresponding to the time-domain white noise signal waveform windowed to a pre-set length of, for example, 256 samples, by a suitable window function, such as a Hamming window. This output signal is transformed by the short-term Fourier transform (STFT) in a STFT unit 402 to produce a noise power spectrum on the frequency axis. The power spectrum from the STFT unit 402 is fed to one input of a multiplier 403 for amplitude processing where it is multiplied with the output of an output noise amplitude control circuit 410. The output of the multiplier 403 is sent to an inverse STFT (ISTFT) unit 404 to be inverse short-term Fourier transformed and converted to a time-domain signal using the phase of the original white noise. The output of the ISTFT unit 404 is sent to the weighted overlap-add circuit 217, which was explained in connection with FIG. 4.

Alternatively, instead of using the arrangement of the white noise generator 401 and the STFT unit 402, it is also possible to generate random numbers and to use them as the real part or the imaginary part or as the amplitude or the phase of the white noise spectrum for processing, thereby omitting the STFT unit 402.

Figure 10:
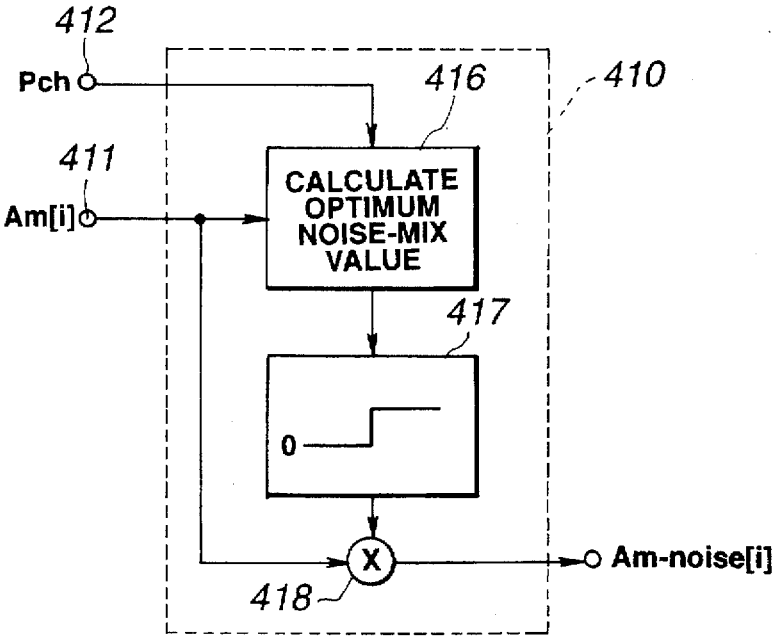
FIG. 10 is a block diagram of the output noise amplitude calculation circuit of FIG. 9 shown in more detail.

The output noise amplitude control circuit 410 has the basic structure shown in FIG. 10 and controls the multiplication coefficients of the multiplier 403, based on the spectral amplitude Am(I) for the voiced sound supplied at terminal 411 from the dequantizer shown in FIG. 4 as the inverse vector quantization unit for the spectral envelope 212, and for the pitch lag Pch supplied at terminal 412 and available at the input terminal 204 of FIG. 4 for finding the synthesized noise amplitude Am- noise[i]. That is, in FIG. 10, a calculation circuit 416 for calculating an optimum noise-mix value fed with the spectral amplitude Am[i] and the pitch lag Pch produces an output that is weighted by a noise weighting circuit 417, and the resulting weighted output is fed to a multiplier 418 where it is multiplied with the spectral amplitude Am[i] for producing a noise amplitude Am- noise[i].

A first illustrative example of noise synthesis and addition, in which the noise amplitude Am-noise[i] becomes a function of two of the above four parameters, namely the pitch lag Pch and the function f1(Pch,Am[i]) of the spectral amplitude Am[i], will be described below.

Among the illustrative examples of these functions f1(Pch,Am[i]), there are f1(Pch,Am[i])=0(0<i<Noise-b×I)

f1(Pch,Am[i])=Am[i]×noise-mix (Noise-b×I≦i<1).

The maximum value of noise-mix is noise-mix-max, which is the clipping point. As an example, K=0.02, noise-mix-max=0.3 and Noise-b=0.7, where Noise-b is a constant for determining in which partial portion of the entire area to begin to add the noise. In the present example, the noise is added beginning from the 70% portion of the entire area, that is, for a range from 4000×0.7=2800 Hz to 4000 Hz for fs=8 kHz.

A second illustrative example of noise synthesis and addition, in which the noise amplitude Am-noise[i] becomes a function of three of the above four parameters, namely the pitch lag Pch, spectral amplitude Am[i], and the function f2(Pch,Am[i],Amax) of the maximum spectral amplitude Amax, explained below.

Among the illustrative examples of these functions f2(Pch,Am[i],Amax), there are f2(Pch,Am[i],Amax)=0(0<i<Noise-b×I)

f2(Pch,Am[i],Amax)=Am[i]×noise-mix(Noise-b×I≦i<I)

noise-max=K×Pch/2.0, where K is a scale factor for adjusting the value of noise-mix.

It is noted that the maximum value of noise-mix is noise-mix-max and, by way of examples, K=0.02, noise-mix-max=0.3 and Noise-b=0.7.

Further, if

Am[i]×noise-mix>A max×C×noise-mix, then f2(Pch,Am[i],Amax)=A max×C×noise-mix.

Since the noise level can be prevented from being increased excessively by this condition, K and noise-mix-max can be enlarged further such that the noise level can be increased if the high-range level is also higher.

A third illustrative example of noise synthesis and addition in which the noise amplitude Am-noise[i] becomes a function f3(Pch,Am[i],Amax,Lev) of all of the above four parameters, will be explained below.

An illustrative example of such function f3(Pch,Am[i], Amax,Lev) is basically the same as the function f2(Pch, SAm[i],Amax) of the above second illustrative example. The residual signal level Lev, however, is the root mean square (rms) of the spectral amplitude Am[i], or the signal level as measured on the time axis. The difference of the present example from the second illustrative example above lies in setting the values of K and noise-mix-max as the functions of Lev. That is, if Lev becomes smaller, the values of L and noise-mix-max may be set to higher values, whereas, if Lev becomes larger, the values of L and noise-mix-max may be set to lower values. Alternatively, the value of Lev may be set so as to be continuously inversely proportional to these values.

Figure 11:
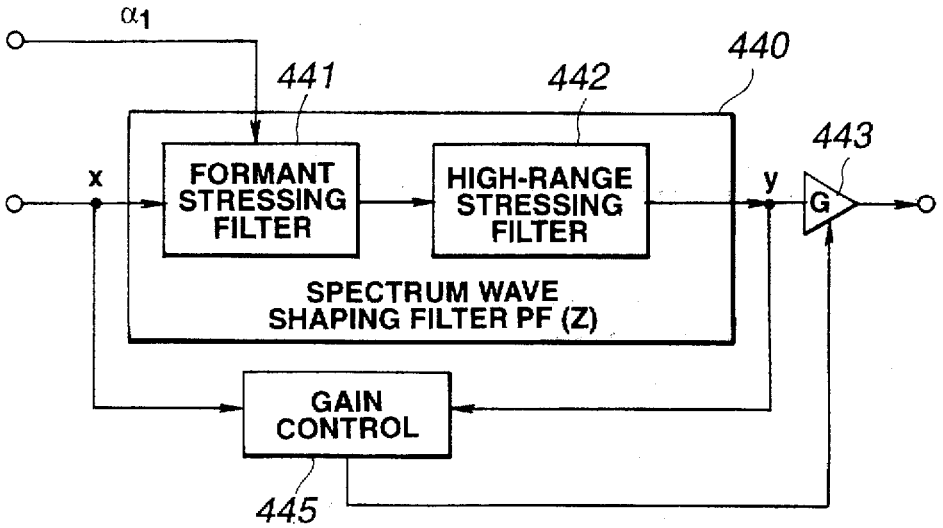
FIG. 11 is a block diagram of a post-filter.
Figure 12:
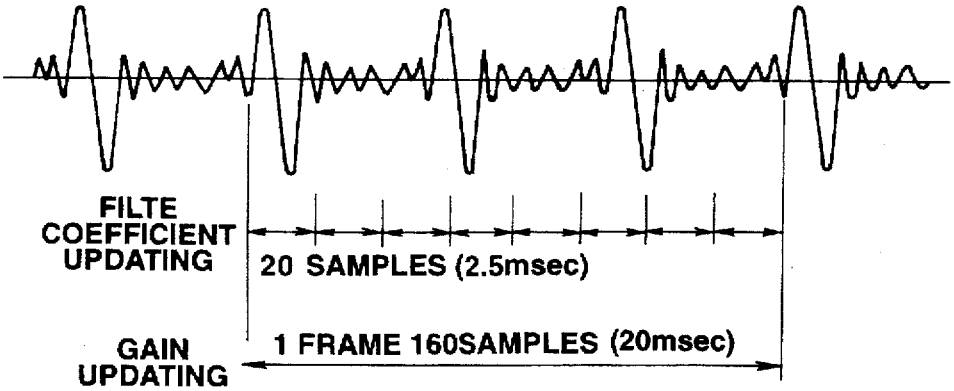
FIG. 12 illustrates the post-filter coefficient updating period and the gain updating period.

The post-filters 238*v*, 238*u* will be explained by referring to FIG. 11 showing a post-filter such as the one employed as the post filter 238*v* or 238*u* of FIG. 4, wherein a spectral shaping filter 440 that forms an essential portion of the post-filter is made up of a formant stressing filter 441 and a high-range stressing filter 442. An output of the spectral shaping filter 440 is sent to a gain adjustment circuit 443 for correcting gain changes caused by the spectral shaping. A gain G of the gain adjustment circuit 443 is set by a gain control circuit 445 which compares the filter input signal x and an output y of the spectral shaping filter 440 to calculate the gain change and produce a correction value.

If the coefficients of the denominators Hv(z) and Huv(z) of the LPC synthesis filters, or the so-called α-parameters, are αi, the characteristics PF(z)of the spectral shaping filter 440 are given by:

$$PF(z)=\frac{\sum_{i=0}^{P} \&\square_i z^{-1}}{\sum_{i=0}^{P} \&\square_i z^{-1}}(1-kz^{-1})$$

The fractional part of the equation represents formant stressing characteristics, while the portion $(1-kz^{-1})$ represents high range stressing filter characteristics. In the equation, β, γ and k are constants, such that, for example, β=0.6, γ=0.8 and k=0.3.

The gain G of the gain adjustment circuit 443 is given by:

$$G=\sqrt{\frac{\sum_{i=0}^{159} x^2(i)}{\sum_{i=0}^{159} y^2(i)}}$$

in which x(i) and y(i) are an input and an output of the spectrum wave filter 440, respectively.

The updating period of the coefficient of the spectrum wave shaping filter 440 is the same as the updating period of the α-parameter, which is the LPC synthesis filter coefficient, that is, 20 samples or 2.5 msec, whereas the updating period of the gain G of the gain adjustment circuit 443 is 160 samples or 20 msec.

By setting the updating period of the gain G of the gain adjustment circuit 443 so as to be longer than that of the coefficient of the spectrum wave shaping filter 440 of the post-filter, it becomes possible to prevent ill effects otherwise caused by gain adjustment fluctuations.

Specifically, in a generic post-filter, the updating period of the spectral shaping filter coefficient and the gain updating period are typically set to be equal to each other. If the gain updating period is 20 samples or 2.5 msec, variation occurs within a single pitch period, thus causing audible click noises. In the present embodiment, the gain switching period is set to be longer, for example, equal to 160 samples for one frame or 20 msec, for preventing gain variations from occurring. Conversely, if the updating period of the spectral shaping filter coefficient is longer, for example, equal to 160 samples or 20 msec, the post-filter characteristics cannot follow the short-term changes in the speech spectrum, such that the satisfactory psychoacoustic sound quality cannot be achieved. More effective post-filtering, however, can be achieved by shortening the filter coefficient updating period to 20 samples or 2.5 msec.

Figure 13:
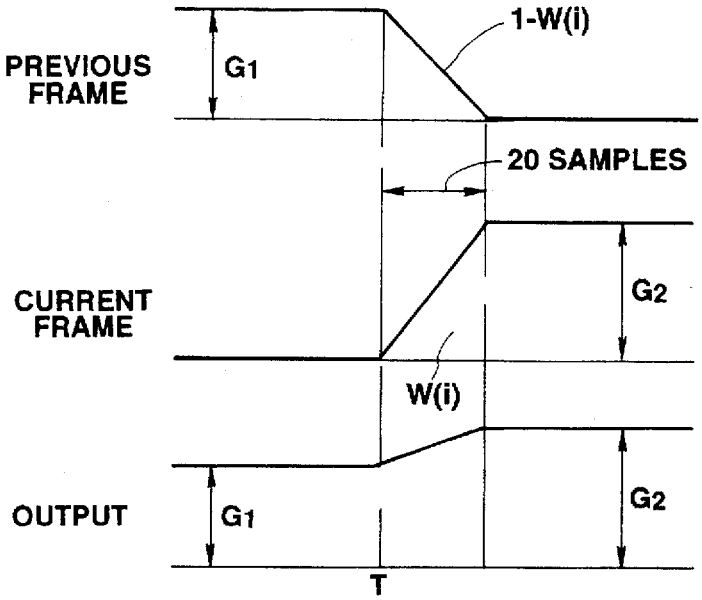
FIG. 13 illustrates a connection operation at a frame boundary portion of the filter coefficient and the post filter gain.

For achieving gain connection between neighboring frames, the results of calculations on the filter coefficient and the gain of the previous frame and those of the current frame are multiplied by triangular windows of W(i)=1/20 (0≦i≦20) and 1−W(i) (0≦i≦20)

for fade-in and fade-out, as shown in FIG. 13. FIG. 13 shows how the gain G1 of the previous frame is changed to the gain G2 of the current frame. More specifically, in the overlapping portion, the proportion of the gain (and the filter coefficient) of the previous frame is decreased gradually while the proportion of the gain (and the filter coefficient) of the current frame is increased gradually. As for the internal state of the filter at time T, both the filter of the current frame and the filter of the previous frame start from the same state, that is, from the last state of the current frame.

Figure 14:
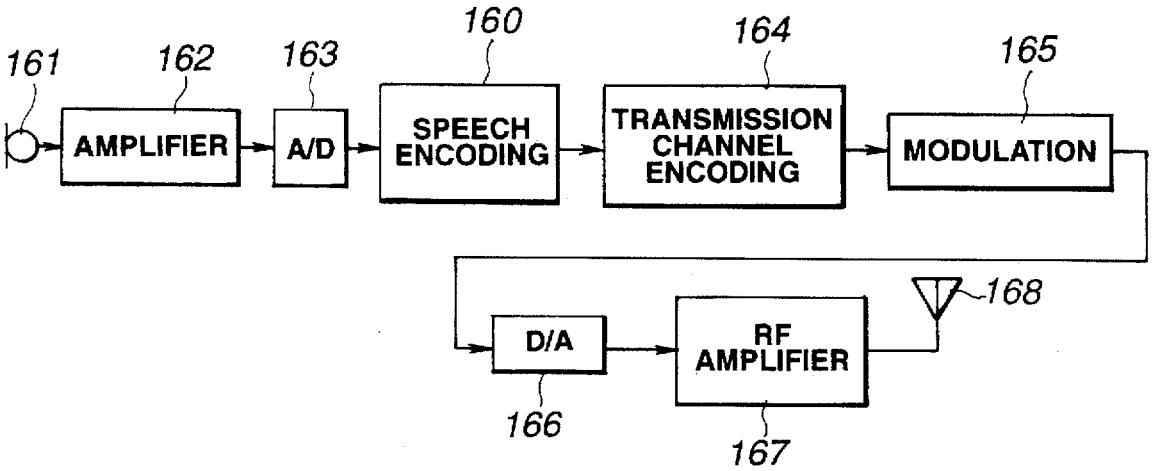
FIG. 14 is a block diagram of the transmitting side of a portable terminal employing the speech signal encoding apparatus of the present invention.
Figure 15:
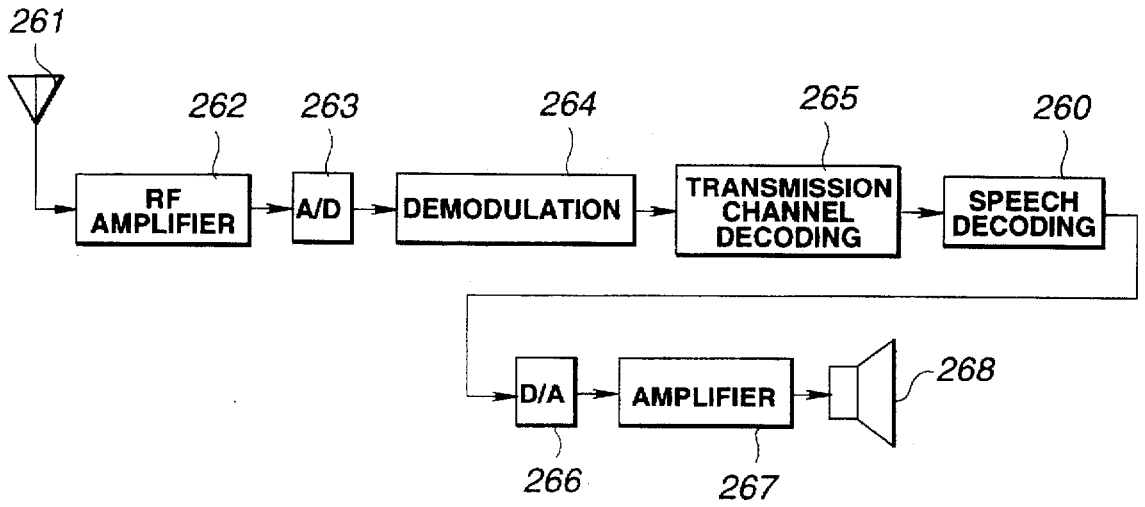
FIG. 15 is a block diagram of the receiving side of the portable terminal employing the speech signal decoding apparatus according to the present invention.

The above-described signal encoding and signal decoding apparatus may be used as a speech codebook employed in, for example, a portable communication terminal or a portable telephone set such as shown in FIGS. 14 and 15.

FIG. 14 shows the transmitting side of a portable communication terminal employing a speech encoding unit 160 configured, for example, as shown in FIGS. 1 and 3. The speech signals collected by a microphone 161 are amplified by an amplifier 162 and converted by an analog/digital (A/D) converter 163 into digital signals that are sent to the speech encoding unit 160, which can be configured as shown in FIGS. 1 and 3. The digital signals from the A/D converter 163 are supplied to the input terminal, which corresponds to terminal 101 in FIGS. 1 and 3, of the encoding unit 160. The speech encoding unit 160 performs encoding as explained in connection with FIGS. 1 and 3. The signals at the output terminals of the encoder of FIGS. 1 and 3 are sent as output signals of the speech encoding unit 160 to a transmission channel encoding unit 164 that performs channel coding on the supplied signals. Output signals of the transmission channel encoding unit 164 are sent to a modulation circuit 165 for modulation and thence supplied to an antenna 168 via a digital/analog (D/A) converter 166 and an RF amplifier 167.

FIG. 15 shows a reception side of a portable terminal employing a speech decoding unit 260 configured as shown in FIGS. 2 and 4. The speech signals received by the antenna 261 of FIG. 14 are amplified by an RF amplifier 262 and sent via an analog/digital (A/D) converter 263 to a demodulation circuit 264, from which demodulated signals are sent to a transmission channel decoding unit 265. An output signal of the decoding unit 265 is supplied to a speech decoding unit 260 configured, for example, as shown in FIGS. 2 and 4. The speech decoding unit 260 decodes the signals in the manner explained in connection with FIGS. 2 and 4. An output signal, corresponding to the signal at output terminal 201 of the unit of FIGS. 2 and 4, is sent as the output signal of the speech decoding unit 260 to a digital/analog (D/A) converter 266. An analog speech signal from the D/A converter 266 is sent through an amplifier 267 to a speaker 268.

The present invention is not limited to the above-described embodiments. For example, although the structure of the speech analysis side (encoder side) of FIGS. 1 and 3 or the structure of the speech synthesis side (decoder side) of FIGS. 2 and 4 are described as hardware, these may also be implemented by a software program using a digital signal processor. On the decoder side, an LPC synthesis filter or a post-filter may be used in common for the voiced speech and the unvoiced speech in place of providing the synthesis filters 236, 237 and the post-filters 238*v*, 238*u* as shown in FIG. 4. The present invention may also be applied to a variety of usages, such as pitch conversion, speed conversion, computerized speech synthesis or noise suppression, instead of being limited to transmission or recording/reproduction. In any case, it is intended that the scope of the invention be defined solely by the appended claims.

What is claimed is:

1. A speech decoding method in which an encoded speech input signal is entered, decoded and subsequently post-filtered, comprising steps of:

performing spectral shaping filtering for spectrally shaping a decoded input signal with a filter coefficient updated within a first period; and performing gain adjustment for correcting gain changes caused by said step of performing spectral shaping filtering, wherein said gain is updated within a second period different from said first period.

2. The speech decoding method as claimed in claim 1 including a step of setting said second period to be longer than said first period.

3. The speech decoding method as claimed in claim 1 wherein said step of performing gain adjustment includes setting the gain by comparing a signal level prior to said step of performing spectral shaping filtering and a signal level subsequent to said step of performing spectral shaping.

4. A speech decoding apparatus in which an encoded speech signal is entered, decoded and subsequently post-filtered, comprising:

spectral shaping filtering means for spectrally shaping a decoded input signal wherein a filter coefficient is updated within a first period; and gain adjustment means receiving an output of said spectral shaping filtering means and wherein a gain is updated within a second period different from said first period.

5. The speech decoding apparatus as claimed in claim 4 wherein said second period is set so as to be longer than said first period.

6. A portable communication terminal apparatus comprising:

amplifier means for amplifying a reception signal received over an antenna;

A/D conversion means for converting the amplified signal to a digital signal;

demodulating means for demodulating the amplified digital signals to produce a demodulated signal;

transmission channel decoding means for channel decoding the demodulated signal; and speech decoding means for decoding an output of said transmission channel decoding means, wherein said speech decoding means includes spectral shaping filtering means for spectrally shaping the decoded input signal and wherein a filter coefficient is updated within a first period;

gain adjustment means fed with an output of said spectral shaping filtering means wherein a gain is updated within a second period different from said first period; and D/A converting means for D/A converting a decoded speech signal and producing an analog speech signal to be supplied to a loudspeaker.

7. The portable terminal apparatus as claimed in claim 6 wherein said second period of said speech decoding means is set so as to be longer than said first period.

8. A speech decoding method whereby an encoded input speech signal is decoded and subsequently post-filtered, comprising steps of:

performing spectral shaping filtering for spectrally shaping a decoded input signal;

updating filtering coefficients within a first period;

performing gain adjustment for correcting gain changes caused by said step of performing spectral shaping filtering; and updating gain levels within a second period different from said first period.

9. The speech decoding method as claimed in claim 8 including a step of setting said second period to be longer than said first period.

10. The speech decoding method as claimed in claim 8 wherein said step of performing gain adjustment includes setting the gain by comparing a signal level prior to said step of performing spectral shaping filtering and a signal level subsequent to said step of performing spectral shaping.

11. Apparatus for decoding an encoded speech signal and for subsequently post-filtering the decoded speech signal, comprising:

spectral shaping filtering means for spectrally shaping a decoded speech signal, wherein a filter coefficient thereof is updated within a first period; and gain adjustment means receiving an output of said spectral shaping filtering means and wherein a gain is updated within a second period longer than said first period.

12. A portable communication terminal apparatus having an antenna, comprising:

A/D conversion means for converting a modulated analog speech signal received over the antenna to a digital speech signal;

demodulating means for demodulating the modulated digital speech signal to produce a demodulated digital speech signal;

transmission channel decoding means for channel decoding the demodulated digital speech signal; and speech decoding means for decoding an output of said transmission channel decoding means, wherein said speech decoding means includes spectral shaping filtering means for spectrally shaping the decoded input signal from said transmission channel decoding means wherein a filter coefficient is updated within a first period, gain adjustment means fed with an output of said spectral shaping filtering means wherein a gain adjustment is updated within a second period different from said first period, and D/A converting means for converting the decoded speech signal and producing an analog speech signal to be supplied to a loudspeaker.

* * * * *